US006612142B1

(12) United States Patent
Capwell

(10) Patent No.: US 6,612,142 B1
(45) Date of Patent: Sep. 2, 2003

(54) GUARD SIDE PASSIVE TWO KEY LOCK

(76) Inventor: Robert G. Capwell, 3242 Grandview Club Rd., Pfafftown, NC (US) 27040

( * ) Notice: Subject to any disclaimer, the term of this patent is extended or adjusted under 35 U.S.C. 154(b) by 0 days.

(21) Appl. No.: 09/616,988

(22) Filed: Jul. 14, 2000

(51) Int. Cl.[7] ..... E05B 21/00; E05B 23/00; E05B 25/00

(52) U.S. Cl. ..... 70/355; 70/337; 70/339

(58) Field of Search ..... 70/337, 339–340, 70/353–355, DIG. 63, 389

(56) References Cited

U.S. PATENT DOCUMENTS

| | | | | | |
|---|---|---|---|---|---|
| 996,726 | A | * | 7/1911 | Murphy | 70/339 |
| 1,611,712 | A | * | 12/1926 | Benham et al. | 70/460 |
| 2,524,696 | A | * | 10/1950 | Ellis | 70/339 |
| 3,336,773 | A | * | 8/1967 | Oechslin | 70/337 |
| 3,837,196 | A | * | 9/1974 | Gartner et al. | 70/339 |
| 3,978,700 | A | * | 9/1976 | Glass | 70/339 |
| 3,983,728 | A | * | 10/1976 | Phillips | 70/339 |
| 4,072,032 | A | * | 2/1978 | Phillips | 70/339 |
| 4,290,287 | A | * | 9/1981 | Peppard | 70/355 |
| 4,332,153 | A | * | 6/1982 | Miles | 70/339 |
| 4,359,884 | A | * | 11/1982 | Miles | 70/339 |
| 4,462,230 | A | * | 7/1984 | Evans | 70/383 |
| 4,561,269 | A | * | 12/1985 | Tanaka | 70/339 |
| 4,580,424 | A | * | 4/1986 | Evans | 70/383 |
| 5,020,347 | A | * | 6/1991 | Logan | 70/389 |
| 5,235,832 | A | * | 8/1993 | Lux et al. | 70/368 |
| 6,129,029 | A | * | 10/2000 | Watson | 109/56 |
| 6,178,792 | B1 | * | 1/2001 | Glazier | 70/389 |

* cited by examiner

*Primary Examiner*—Anthony Knight
*Assistant Examiner*—John B. Walsh
(74) *Attorney, Agent, or Firm*—Dennis A. Gross; The Hill Firm

(57) ABSTRACT

A safety deposit box lock assembly has a housing and latch bolt carried by the housing. The latch bolt is movable between a locked and an unlocked position relative to the housing. A guard lock is provided as part of the lock assembly and is movable by a guard key between an unsecured orientation and a secured orientation. The guard lock permits movement of the latch bolt to the unlocked position when the guard lock is in the unsecured orientation. The guard lock prohibits movement of the latch bolt to the unlocked position when the guard lock is in the secured orientation. A patron lock is provided as part of the lock assembly and is movable by a patron key between a latched orientation and an unlatched orientation. The latch bolt is in the locked position when the patron lock is in the latched orientation. The latch bolt is in the unlocked position when the patron lock is in the unlatched orientation. However, the patron lock can be moved to the unlatched orientation only when the guard lock is in the unsecured orientation. The guard lock is a passive lock wherein the guard key can be inserted into and removed from the guard lock both when the guard lock is in the secured orientation and in the unsecured orientation.

19 Claims, 4 Drawing Sheets

FIG. 7
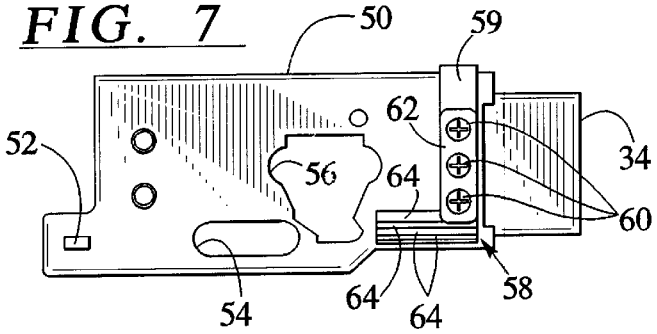
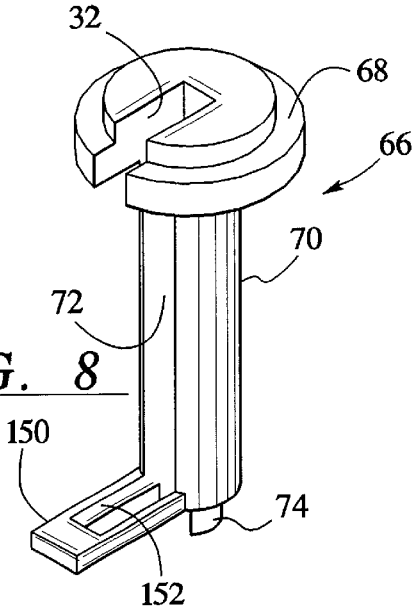
FIG. 8
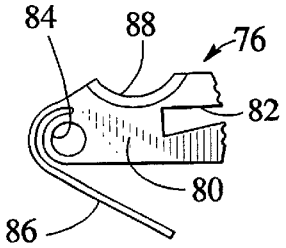
FIG. 9
FIG. 10
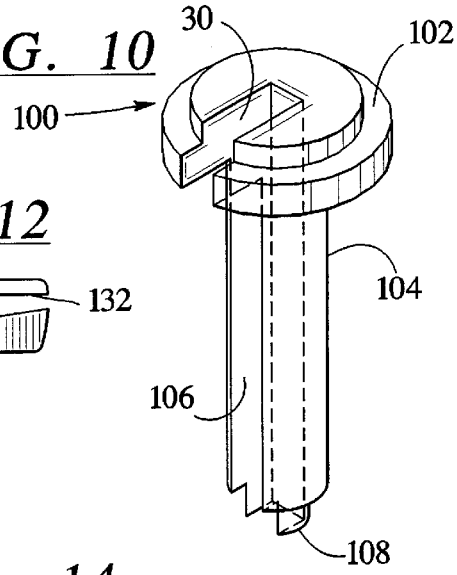
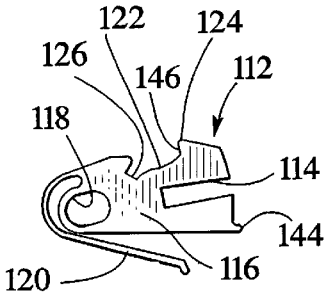
FIG. 11
FIG. 12
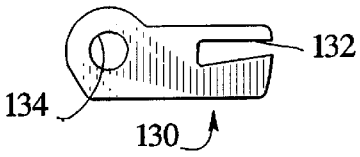
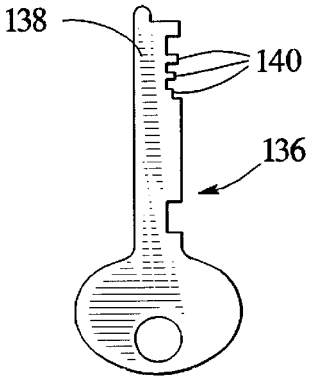
FIG. 13
FIG. 14
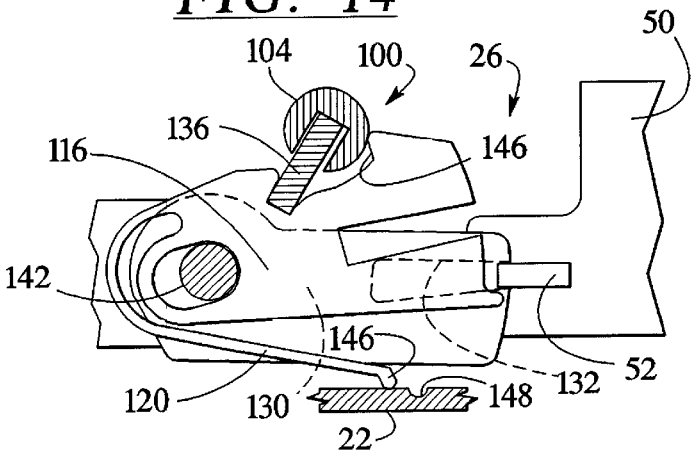

FIG. 15
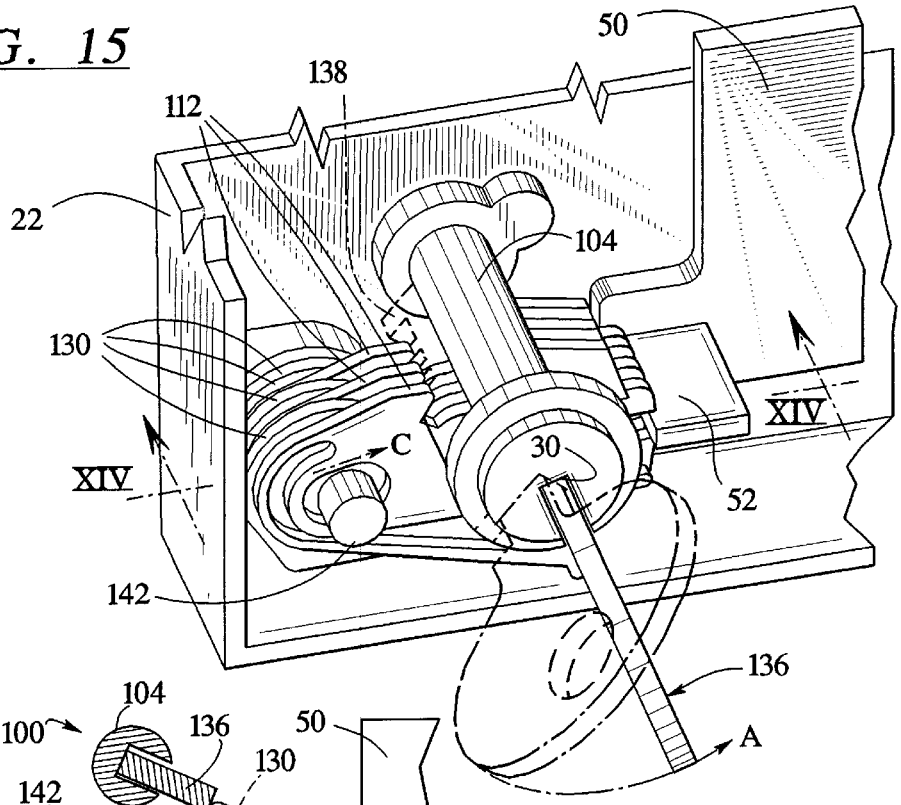
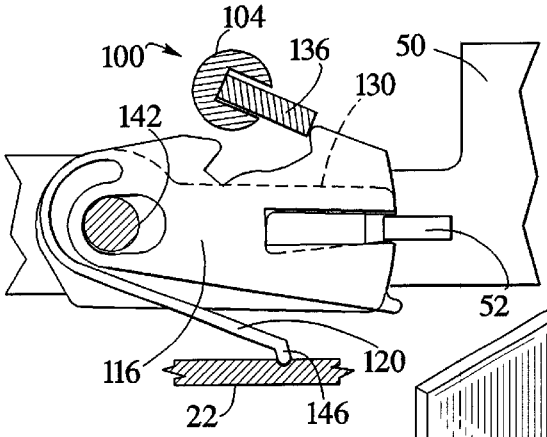
FIG. 16
FIG. 17
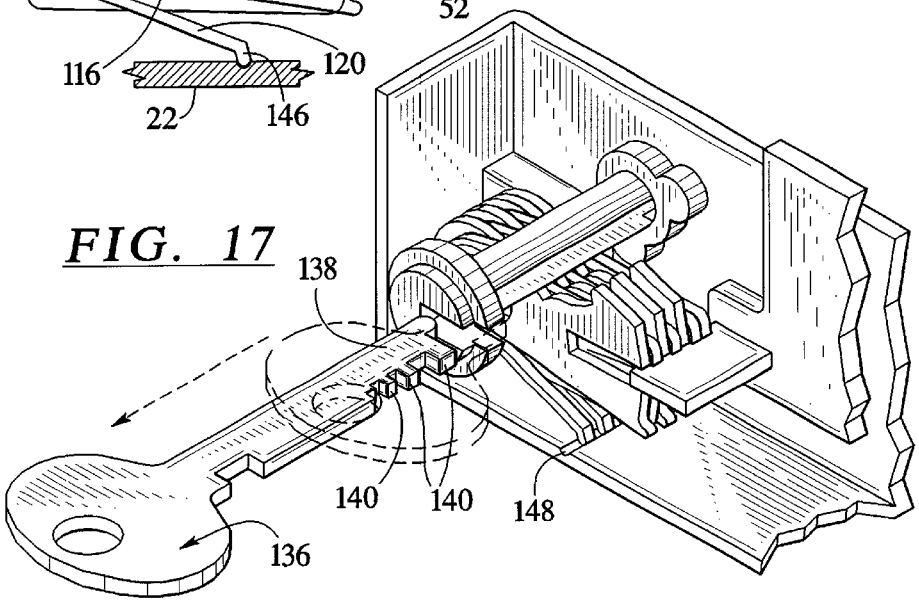

GUARD SIDE PASSIVE TWO KEY LOCK

BACKGROUND OF THE INVENTION

1. Field of the Invention

The present invention is generally directed to key operated locks, and more particularly to a lock assembly for a safety deposit box with a guard side passive lock and a patron side lock wherein the key can be removed from the guard side lock when in the locked or the unlocked position.

2. Description of the Related Art

Two key lock assemblies are known in the art and are commonly used for safety deposit boxes and the like. Such lock assemblies typically require an authorized person to first unlock the lock assembly using a first key. The authorized person uses a first key and places the lock components in an unsecured orientation that permits a second person to lock and unlock the lock assembly, if so desired, with a second key. If the first authorized person, such as a bank security guard, does not unsecure the assembly, the second authorized person, such as a bank patron that owns or rents the safety deposit box, cannot access the box utilizing their second key.

A conventional safety deposit box assembly requires a security guard or another authorized person to insert the first key into the first lock in order to unsecure a guard lock. Under conventional circumstances, the security guard key cannot be removed from the lock assembly after it is moved to the unsecured orientation. Therefore, the security guard must leave the key with the owner and the safety deposit box or must remain in the presence of the key during the entire time that the owner of the safety deposit box utilizes the box. If the security guard must leave the presence of the box owner, the security guard key is available to the box owner without supervision. If the security guard remains in the presence of the box owner during the time that the safety deposit box is being used, the security guard cannot perform other duties. This situation either raises security concerns or reduces the efficiency of the security guard.

SUMMARY OF THE INVENTION

It is therefore one object of the present invention to provide a guard side passive two key lock assembly for a safety deposit box that does not require the guard key to remain in the lock assembly when in an unsecured orientation. It is another object of the present invention to provide such a lock assembly that permits the guard key to be inserted into a guard side passive lock assembly to unsecure the assembly and then to be removed prior to insertion of a patron side key. It is another object of the present invention to provide such a lock assembly that permits constant supervision of the guard side key by permitting the key to remain in the presence of authorized personnel at all times. It is yet another object of the present invention to provide such a lock assembly that improves the job efficiency of security guard personnel by permitting the security guard personnel to unsecure a safety deposit box guard lock without requiring them to remain in the presence of the box owner during use of the safety deposit box.

These and other objects, features, and advantages are provided by a guard side passive two key lock assembly of the present invention. In one embodiment, a safety deposit box lock assembly includes a housing and a latch bolt carried by the housing. The latch bolt is moveable between a locked and an unlocked position relative to the housing.

The lock assembly has a guard lock that is moveable by a guard key between an unsecured orientation permitting movement of the latch bolt to the unlocked position and a secured orientation prohibiting movement of the latch bolt to the unlocked position. The lock assembly also includes a patron lock that is moveable by a patron key between a latched orientation that moves the latch bolt to the locked position and an unlatched orientation that moves the latch bolt to the unlocked position. The patron lock is moveable to the unlatched orientation only when the guard lock is in the unsecured orientation. The guard key of the lock assembly can be inserted into and removed from the guard lock both when the guard lock is in the secured and the unsecured orientation.

In one embodiment, the lock assembly further comprises a pin extending upward from a portion of the latch bolt and at least one guard lock tumbler lever. A pin slot is formed in each guard lock tumbler lever wherein the pin slots align with one another and with the pin when the guard lock is in the unsecured orientation.

In one embodiment, the lock assembly also includes at least one guard lock tumbler lever and a cam surface on an edge of each guard lock tumbler lever. Each of the cam surfaces bears against a portion of the guard key when rotated to move each guard lock tumbler lever.

In one embodiment, the lock assembly includes a plurality of guard lock tumbler levels and a cam surface on an edge of each of the guard lock tumbler levers. Each cam surface has at least one notch that align with one another when the guard lock is in the unsecured orientation to permit insertion and removal of the guard key in the unsecured orientation.

In one embodiment, the lock assembly includes a terminus at one edge of each cam surface of each guard lock tumbler lever that align with one another when the guard lock is in the secured orientation to permit insertion and removal of the guard key in the secured orientation.

In one embodiment, the lock assembly also includes a bolt plate carrying the latch bolt and includes a guard key post passing through a slot in the bolt plate and arranged generally perpendicular to the plate. A key groove is formed along the longitudinal axis of the post that guides a portion of the guard key along the post when the key is inserted in the guard lock. The key groove aligns with each notch in each tumbler lever cam surface when the guard lock is in the unsecured orientation.

In one embodiment, the key groove of the guard key post is positioned beyond the terminus of each tumbler lever cam surface when the guard lock is in the secured orientation.

In one embodiment, the lock assembly also includes a plurality dummy tumbler levers that each have a perimeter surface that does not intersect with a path of the notches. In this manner, the dummy tumbler levels do not interfere with insertion and removal of the guard key when the guard lock is in any orientation.

In one embodiment, the lock assembly includes a plurality of the dummy levers each having a perimeter surface with a terminus that aligns with the terminus of each guard lock tumbler lever cam surface. In this manner, the dummy tumbler levels do not interfere with insertion and removal of the guard key when the guard lock is in any orientation.

In another embodiment of the invention, a safety deposit box lock assembly includes a housing and a bolt plate received in and moveable relative to the housing between a locked and an unlocked position. A latch bolt is carried by the bolt plate and extends from the side of the housing when the bolt plate is in the unlocked position and at least partially retracts into the housing when the bolt plate is in the unlocked position. The lock assembly also includes a guard key opening in a face of the housing that is adapted to receive a guard key therein. The lock assembly includes a guard lock that is actuated by rotating the guard key when inserted in the guard key opening. The guard lock permits movement of the bolt plate to the unlocked position when in a unsecured orientation and prohibits movement of the bolt plate to the unlocked position when in a secured orientation. The lock assembly also includes a patron key opening in the face of the housing that is adapted to receive a patron key therein. A patron lock is actuated by rotating the patron key when inserted in the patron key opening. The patron lock moves of the bolt plate to the unlocked position only when the guard lock is in the unsecured orientation and when the patron lock is moved to an unlatched orientation. The guard key can be inserted into and removed from the guard key opening both when the guard lock assembly is in the secured and in the unsecured orientation.

These and other objects, features and advantages of the present invention will become apparent upon a review of the detailed description and accompanying drawing Figures. Changes and modifications can be made to the disclosed and illustrated embodiments. These embodiments are provided herein to illustrate aspects of the present invention and not in any way to limit the scope of the invention. The present invention is therefore intended to encompass these changes and modifications.

BRIEF DESCRIPTION OF THE DRAWINGS

FIG. 7 illustrates a plan view of a latch plate of the lock assembly of FIG. 1.

FIG. 8 illustrates a perspective view of a key post for the patron lock of the lock assembly of FIG. 1.

FIG. 9 illustrates a plan view of a tumbler lever of the patron lock of the lock assembly of FIG. 1.

FIG. 10 illustrates a perspective view of a key post for the guard lock of the lock assembly of FIG. 1.

FIG. 11 illustrates a plan view of a tumbler lever of the guard lock.

FIG. 12 illustrates a plan view of a dummy tumbler lever of the guard lock.

FIG. 13 illustrates a plan view of a guard key for use with the lock assembly of the present invention.

FIG. 14 illustrates a fragmentary partial cross-section of the guard lock components in the secured orientation.

FIG. 15 illustrates a fragmentary perspective view of the guard lock as the guard key is being rotated toward the unsecured orientation.

FIG. 16 illustrates a fragmentary partial cross-section of the guard lock components in the unsecured orientation.

FIG. 17 illustrates a fragmentary perspective view of the guard lock components with the guard key rotated to the unsecured orientation.

DETAILED DESCRIPTION OF THE PREFERRED EMBODIMENTS

The present invention is for a lock assembly that is well suited for safety deposit boxes and the like. The lock assembly has two locks including a guard lock and a patron lock that require two separate keys to actuate the lock assembly. Such locks are generally known in the art. The guard lock must be actuated and moved to an unsecured orientation and then the patron lock can be utilized to lock and unlock a latch bolt of the assembly. If the guard lock remains in a secured orientation, the patron lock cannot actuate the latch bolt. The present invention is directed to such a lock assembly. However, the guard lock permits the guard key to be inserted and removed both when the guard lock is the secured and in the unsecured orientation. This permits a guard or other authorized personnel to set the guard lock in an unsecured orientation so that a patron can actuate the lock assembly as desired, and yet permits the guard to remove the key and perform other duties and tasks while the patron accesses their own safety deposit box.

The detailed description of the present invention may refer to upper and lower positions, left and right positions, front and back positions as well as other special positions and orientations. These labels are used herein only to simply the description. As will be apparent to those skilled in the art, the lock assembly of the invention can be orientated and positioned in virtually in any posture and yet function as needed. The particular labels and terms are utilized herein only to assist in describing the relationship of certain components relative to one another.

Figure 1:
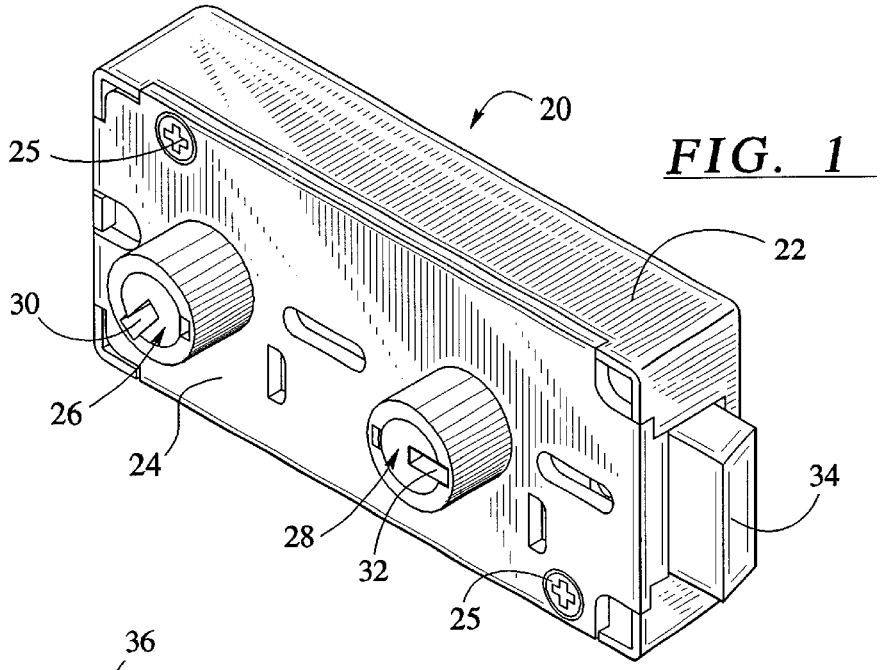
FIG. 1 illustrates an elevational perspective view of a safety deposit lock assembly constructed in accordance with one embodiment of the present invention.

Referring now to the drawings, FIG. 1 illustrates a perspective view of a lock assembly 20 constructed in accordance with one embodiment of the present invention. The lock assembly 20 includes an exterior housing 22 and a front opening covered by a cover plate 24. The housing 22 and cover plate 24 together define an enclosure for the various components of the lock assembly 20. A guard lock is provided and generally illustrated at 26. A patron lock is also provided and generally illustrated at 28. The guard side lock 26 includes a guard key axis 30 and the patron side lock 28 includes a patron key axis 32. Each key axis 30 and 32 is for receiving a different key therein to actuate the respective guard or patron lock 26 and 28. The lock assembly 20 also includes a latch bolt 34 extending from one side of the housing 22. The latch bolt 34 extends from the housing when in a locked position and is retracted at least partly into the housing when in an unlocked position.

Figure 2:
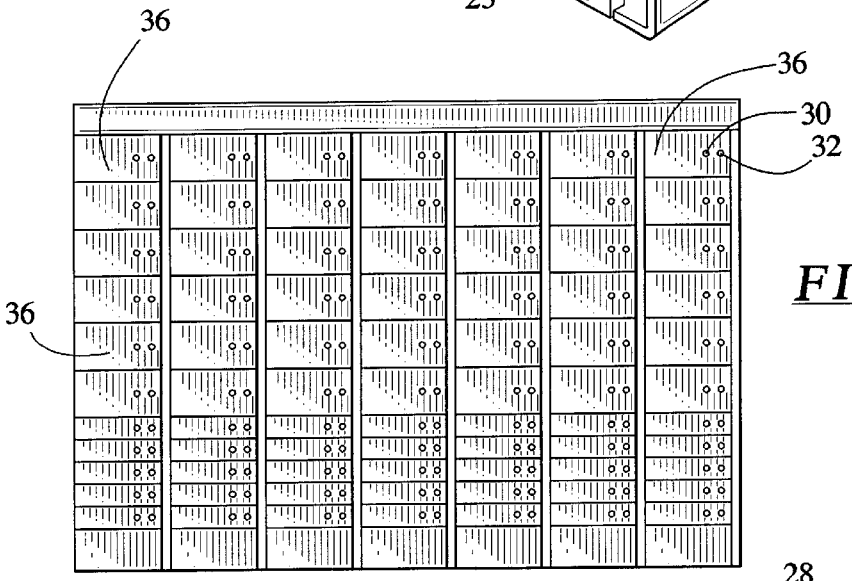
FIG. 2 illustrates a front view of a plurality of safety deposit boxes incorporating the lock assembly illustrated in FIG. 1.

FIG. 2 generally illustrates a front view of a plurality of safety deposit boxes 36 of different shapes and sizes. Each of the boxes 36 includes a lock assembly 20 disposed behind a front surface of the box. The key axis 30 and 32 of each of the locks 26 and 28 is exposed and visible on a front surface of each safety deposit box 36. Safety deposit boxes are often provided by a bank or other financial institution as a secure storage device for bank patrons. Bank patrons can store important papers and valuable items in the safety deposit boxes within the security of the bank building. Each of the safety deposit boxes 36 can individually include a lock assembly 20 with a guard lock and a patron lock that requires both a guard or other bank employee and an individual patron to access the safety deposit box.

Figure 3:
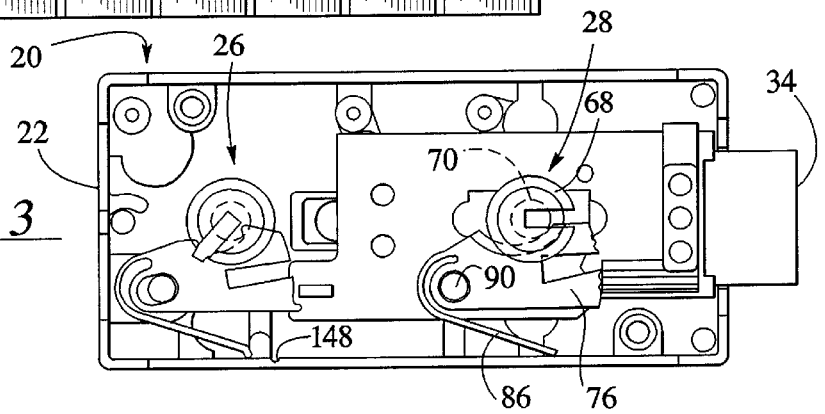
FIG. 3 illustrates a front view of the lock assembly illustrated in FIG. 1 in a locked and secured position and with a cover panel removed.
Figure 4:
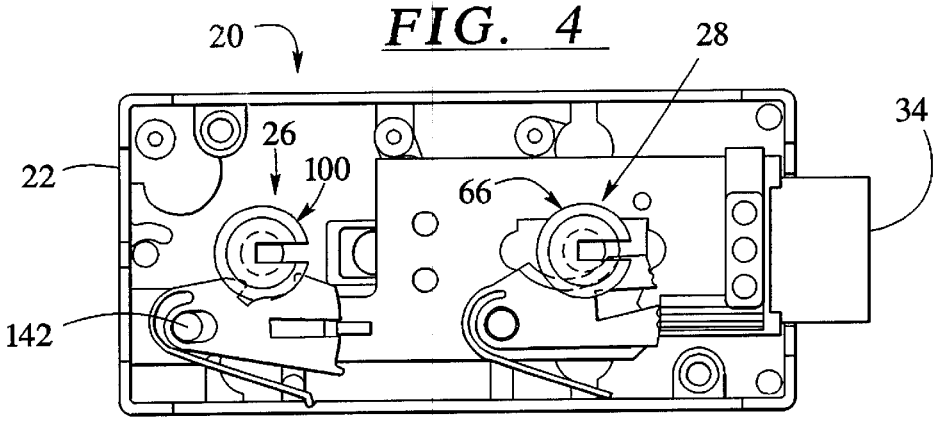
FIG. 4 illustrates the lock assembly of FIG. 3 with the passive guard lock of the lock assembly in an unsecured orientation.
Figure 5:
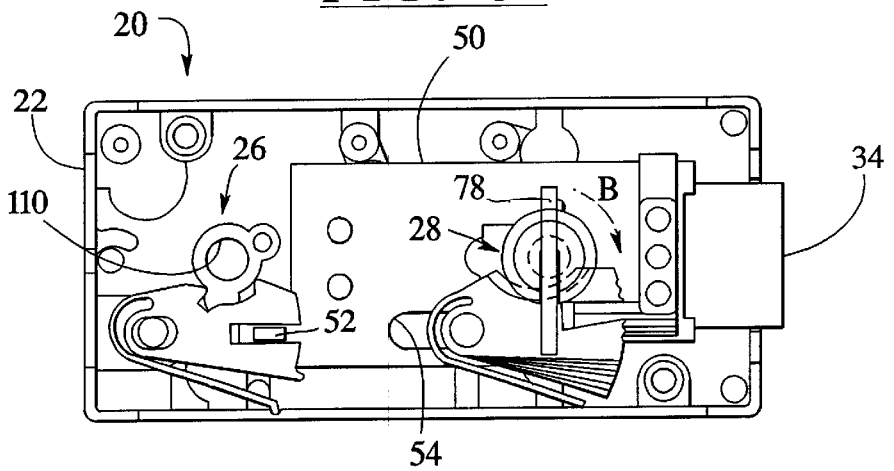
FIG. 5 illustrates the lock assembly of FIG. 3 in an unlatched position.
Figure 6:
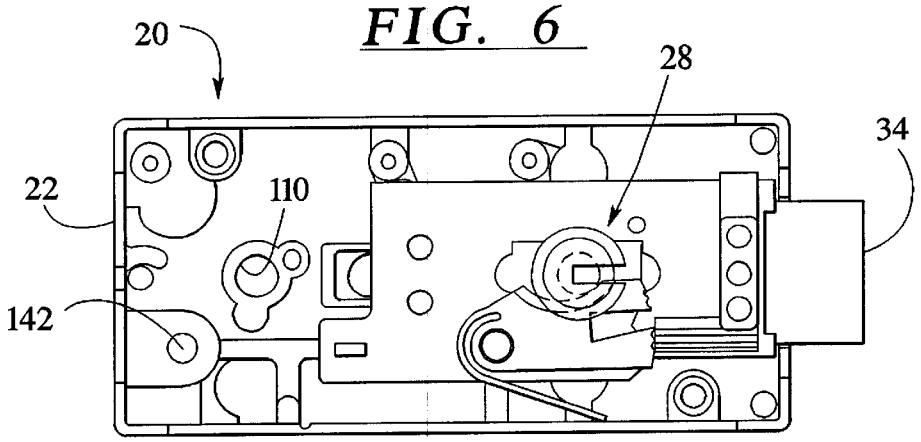
FIG. 6 illustrates the lock assembly of FIG. 3 wherein the guard lock components have been removed.

FIGS. 3–6 illustrate the lock assembly 20 with the front cover pate 24 removed and with the latch bolt 34, the guard lock 26 and patron lock 28 in various positions and orientations. FIG. 3 illustrates the lock assembly 20 in a locked position wherein the latch bolt 34 is completely extending from the housing 22. The guard lock 26 is in a secured orientation as in described in more detail below. The patron lock 28 is in a latched orientation which is also described in more detail below. FIG. 4 illustrates the lock assembly 20 wherein the guard lock 26 is in an unsecured orientation and wherein the patron lock 28 remains in the latched orientation and the latch.bolt 34 remains in the locked position. FIG. 5 illustrates the guard lock 26 in the unsecured orientation and the patron lock 28 in an unlatched orientation. The latch bolt 34 is in the unlocked position and is as least partly retracted into the housing 22. FIG. 6 simply illustrates the lock assembly 20 wherein the components of the guard lock 26 are removed to show features of the housing 22 associated with the components of the guard lock.

The general components that are internal to the housing 22 and define the guard lock 26 and the patron lock 28 are described herein. The general function of the patron lock is described in some detail but generally functions in a manner known in the art. The particular function of the guard lock 26 is described in more detail.

In that regard, FIG. 7 illustrates a latch plate 50 that is received within the housing 22 and slidable relative to the housing. The latch bolt 34 extends from one end of the latch plate 50. The latch plate 50 includes a pin 52 extending perpendicular to the plate and forward from the plate. The latch plate 50 also includes a first slotted opening 54 and a second contoured opening 56 formed through the plate. The significance of the pin 52 and opening 54 and 56 will be described in greater detail in conjunction with the corresponding lock components.

A plurality of L-shaped fence elements 58 are stacked on the front surface of the latch plate 50. These fence elements each include a vertical leg 59 that is secured to the latch plate by a plurality of fasteners 60 and a press plate 62. Each, of the fence elements 58 also include a horizontal fence leg 64 that extends away from the latch bolt 34 and generally terminates at the same point as the other legs 64. These L-shaped fence elements and particularly the fence legs 64 define a desired fence arrangement for the patron lock 28 as is described below.

FIG. 8 illustrates a patron key post 66 including a head 68, an elongate shaft 70 and a patron key groove 72 formed along a longitudinal axis of the post 66. The top end of the key groove 72 in the head 68 defines part of the patron key axis 32. The patron key post 66 includes a tapered end 74 received in a corresponding cup (not shown) in the housing 22 to locate or position the post. The post, when installed, extends generally perpendicular to and forward from the housing 22.

FIG. 9 illustrates one of a plurality of patron lock tumbler levers 76 that bear against a patron key 78 (FIG. 5) when the patron lock is actuated. Each tumbler lever 76 of the patron lock 28 includes a body 80, a fence slot 82 at a right side of the lever, and a pivot pin opening 84 near a left side of the lever. A spring arm 86 extends from the left side of the lever and generally downward and toward the right side of the body. The spring arm 86 bears against the housing 22 and biases the lever upward. A curved or arcuate cam surface 88 is defined on a top edge of the lever. A plurality of identical tumbler levers 76 are received over a pivot pin 90 extending forward from the housing 22. Each of the tumbler levers 76 pivots about the pin 90 and is biased toward the post 66 by the spring arm 86 of each respective lever 76.

FIG. 3 generally illustrates the patron lock 28 including all of its components in a latched orientation wherein the latch bolt 34 is completely extended from the housing 22. Each of the tumbler levers 76 is in generally the same orientation relative to the pin 90. The cam surface 88 of each lever bears against the shaft 70 of the patron key post 66. To actuate the patron lock 28, each of the levers 76 must be moved downward against the biasing force of each corresponding spring arm 86 so that each fence slot 82 aligns with a corresponding one of the fence legs 64 of the L-shaped fence elements 58. In order to accomplish this, the patron key 78 includes a plurality of teeth or irregular surfaces, similar to the key illustrated in FIG. 13. The teeth are arranged at different heights and spaced apart along the key. Each individual surface is positioned so as to contact only one of the cam surfaces 88 of a respective lever 76. The contour of the teeth of the key correspond exactly to the relative positioning of each of the fence elements 58 and particularly the fence legs 64 with respect to one another. The arrangement of each fence element 58 relative to one another can be varied in order to accommodate different keys so that each lock requires a different patron key.

When the key 78 is inserted into the axis 32 and further into the key groove 72 of the post 66, the key bottoms out against a lower surface of the housing 22. The key can be rotated in order to actuate the patron lock 28 as described below. Each particular surface of the key 78 will contact its respective lever 76, moving each of the levers so that the fence slots 82 align with the corresponding fence legs 64. In this manner, the latch plate 50 can be moved to the left as is illustrated in FIG. 5 wherein each leg 64 is received within its corresponding fence slot 82. The general function of the patron lock as described is known in the art.

FIG. 10 illustrates a guard key post 100 that also includes a head 102, a shaft 104 and a guard key slot 106 formed along the longitudinal axis of the post. The post 100 also includes a tapered end 108 that is received in a corresponding cup 110 formed in the housing 22. The cup 110 is illustrated in FIGS. 5 and 6 wherein the post has been removed. The top end of the key groove 106 again defines part of the key axis 30 for the guard key.

FIG. 11 illustrates one of a plurality of guard lock tumbler levers 112. Each tumbler lever 112 is different than the more conventional patron lock tumbler lever 76 to achieve one or more goals of the present invention. In particular, each guard lock tumbler lever 112 includes a pin slot 114 formed on a right side of a body 116 and a slotted opening 118 formed near the left side of the body. A spring arm 120 extends from the left side of the body generally downward and toward the right side. The top surface of the body 116 includes a cam surface 122 that bears against a corresponding surface of a guard key (FIG. 13). The cam surface 122 at a right side includes a terminus 124 defining an end of the cam surface and a notch 126 at the opposite end of the cam surface.

In the present embodiment, the guard lock 26 also includes one or more optional dummy tumbler levers 130. Each of the dummy levers 130 includes a pin slot 132 on a right side of the lever and a pivot pin opening 134 near the left side of the lever. As will be described in greater detail below, the dummy levers 130 can be intermittently dispersed next to or between the guard lock tumbler levers 112 in order to produce a desired key pattern. For example, a guard key 136 is illustrated in FIG. 13 and includes a multi-faceted surface on one edge of the key. The surface is formed on an end 138 that is received within the key axis 30 and guard key groove 106 of the post The multi-faceted surface includes a plurality of discrete and spaced apart surfaces 140 that are each intended to contact the cam surface 122 of respective ones of the guard key tumbler levers 112. These surfaced 140 bear against the cam surfaces 112 in order to move the tumbler levers 112 to actuate the guard lock 26.

In operation, the guard lock tumbler levers 112 are received within the housing 22 and are interspersed with the optional dummy tumbler levers 130. Each of the openings 118 and 134, respectively, are received over a pivot pin 142 protruding forward from the housing 22. The spring arms 120 of the guard lock tumbler levers 112 bear against the side of the housing 22 in order to bias the tumbler levers toward the post 100. Each of the guard lock tumbler levers 112 includes a protruding tab 144 that extends beyond the right side edge of the body 116. This tab contacts the pin 52 of the bolt plate 50 in order to prevent the tumbler levers from moving beyond that point toward the post 100. This prevents binding of the guard lock components.

Each stage of actuating the lock assembly is now described referring to FIGS. 3–5 and FIGS. 14–17. As described above, FIG. 3 illustrates the lock assembly 20 with the latch bolt 34 in the locked position, the patron lock 28 in the latched orientation, and the guard lock 26 in the secured orientation. The guard lock 26 as illustrated in FIG. 3 only illustrates one tumbler lever 112 wherein the pin slot 114 is biased away from the pin 52 so that the body of the lever blocks the pin 52 and hence the bolt plate 50 from traveling to the left. FIG. 14 shows a partial fragmentary cross-section through the lock assembly 26 in FIG. 3. FIG. 14 provides a better illustration of the components of the guard lock 26 in the secured orientation. Each guard lock tumbler lever 112 is biased toward the post 100 by the spring arm 120 so that the body of the lever blocks movement of the pin 52 to the left. As illustrated in phantom view, each of the dummy levers 130 including the pin slots 132 remain aligned with the pin 52. The dummy levers do not affect the secured or unsecured orientation characteristics of the guard lock 26. The dummy levers 130 instead simply provide spacing between the tumbler levers 112 in order produce a desired key pattern.

In the secured orientation, the guard lock tumbler levers 112 are biased toward the left so that the pivot pin 142 is shifted to the right end of the pin slot 118 in each tumbler lever 112. By biasing each tumbler lever 112 to the left, the pin slot 114 is clear of the pin 52 and can therefore pivot toward the post 100. In this secured orientation, the key 136 and the key groove 106 of the post 100 directly align with each of the notches 126 in each of the tumbler levers 112. The dummy levers 130 do not interfere or intersect with any portion of these notches 126 or the groove 106. In this secured orientation, the guard key 136 can be inserted into the axis 30 and removed from the key axis as desired.

FIG. 15 illustrates the guard lock 26 moving toward the unsecured orientation and in a perspective fragmentary view. In order to move the guard lock 26 to the unsecured position shown in FIG. 4, the key is rotated in the direction of the arrow A shown in FIG. 15. By rotation of the key 136, the various surfaces 140 of the multi-faceted key surface, bear against the respective cam surfaces 122 of the tumbler levers 112 forcing each tumbler lever downward against the spring force of the spring arm 120. Each tumbler lever 112 is moved downward an appropriate distance defined by the key surface 140 until the pin slot 114 of each tumbler lever aligns with the pin 52. As the key moves toward the terminus 124 of each cam surface 122, the key abuts a bearing surface 146 to drive each of the guard lock tumbler levers 112 to the right. The slotted opening 118 permits such movement of each tumbler lever wherein the pivot pin is shifted to the left side of each slot 118. A down-turned tip 146 of each spring arm 120 moves to the right and snaps into a groove 148 in the housing 22. The pin 52 is then partly received in each of the slots 114 of each tumbler lever. This is best illustrated in FIG. 16 wherein each tumbler lever 112 and slot 114 is aligned with the pin 52 so that no further impediment is created by the guard lock 26 for movement of the latch plate 50 to the left. As illustrated in FIG. 17, the key 136 is generally in a horizontal position when in the unsecured orientation. In this horizontal position, the key groove 106 and all surfaces of the key 136 are clear of the dummy levers 130 and the tumbler levers 112. Therefore, the key can be inserted and removed into the key axis 30 at will in the unsecured orientation as well.

When the patron lock 28 is in the latched orientation, the latch bolt 34 remains in the locked position illustrated in FIGS. 3 and 4. As the patron key is rotated in the direction of the arrow B as illustrated in FIG. 5, the patron lock tumbler levers 76 including the fence slots 82 align with the fence legs 64 above. As the key 78 is further rotated, the key and post 66 drive the latch plate 50 to the left. Therefore, with the patron lock 28 in the unlatched orientation illustrated in FIG. 5, the latch bolt 34 is in the unlocked position. However, if the guard lock 26 were to remain in the secured orientation, the pin 52 is prevented from moving to the left. Therefore even when the patron lock is moved to the unlatched orientation, the latch plate 50 and hence the latch bolt 34 would remain in the lock position.

To drive the latch plate 50, the patron lock 26 includes a positive drive that contacts and moves the latch plate 50 when the patron key 78 is rotated. The lower end of the shaft 70 of the patron post 66 includes a drive arm 150 that extends radially outward from the shaft. The drive arm 150 is received in the enlarged contoured opening 56 of the latch plate 50. A bottom end of the patron key 78 rests in an opening 152 in the drive arm 150 and bears against surfaces of the opening when rotated. Therefore, when rotating the patron key 78, the drive arm 150 bears against the latch plate 50 within the opening 56 and drives the latch plate in the direction of movement of the drive arm 150. This movement is prevented when the guard lock 26 is in the secured orientation.

In order to provide unique tumbler and key configurations, the multi-faceted surface of the key 136 can include many variations of the surfaces 140. The configuration of the guard lock tumbler levers 112 must accommodate these different surface configurations. Therefore, the distance between the pins slot 114 of each tumbler lever 112 and the cam surface 122 vary according to the height of each key surface 140. As will be evident to those skilled in the art, many key and surface variations are therefore possible. The embodiment disclosed herein is provided merely to illustrate the passive guard lock function.

The materials utilized to fabricate the various components of the present invention can also vary considerably and yet fall within the scope of the present invention. Similarly, the configuration and construction of the housing, latch plate, latch bolt, key pins, tumbler levers, and the like can also vary and yet fall within the scope of the present invention.

Modifications and changes can be made to the embodiments disclosed herein. These modifications and change are intended to fall within the scope of the present invention. The disclosed embodiments are provided herein to illustrate aspects of the present invention and not to limit the scope of the invention. The scope of the invention is to be limited only by the appended claims.

I claim:

1. A safety deposit box lock assembly comprising:

a housing;

a latch bolt carried by the housing and moveable between a fully extended locked position and an unlocked position;

a guard lock movable by a guard key between an unsecured orientation permitting movement of the latch bolt to the unlocked position and a secured orientation prohibiting movement of the latch bolt to the unlocked position from the extended locked position;

a patron lock moveable by a patron key between a latched orientation that moves the latch bolt to the locked position and an unlatched orientation that moves the latch bolt to the unlocked position only when the guard lock is in the unsecured orientation; and wherein the guard key can be inserted into and removed from the guard lock both when the guard lock is in the secured orientation and in the unsecured orientation and wherein removal of the guard key in the unsecured orientation of the guard lock will not prevent movement of the latch bolt to the unlocked position from the fully extended locked position.

2. A safety deposit box lock assembly comprising:

a housing;

a latch bolt carried by the housing and moveable between a fully extended locked position and an unlocked position;

a guard lock movable by a guard key between an unsecured orientation permitting movement of the latch bolt to the unlocked position and a secured orientation prohibiting movement of the latch bolt to the unlocked position from the fully extended locked position;

a patron lock moveable by a patron key between a latched orientation that moves the latch bolt to the locked position and an unlatched orientation that moves the latch bolt to the unlocked position only when the guard lock is in the unsecured orientation; and wherein the guard key can be inserted into and removed from the guard lock both when the guard lock is in the secured orientation and in the unsecured orientation, further comprising:

a pin extending from a portion of the latch bolt;

at least one guard lock tumbler lever; and a pin slot formed in each guard lock tumbler lever wherein each pin slot is aligned with the pin when the guard lock is in the unsecured orientation and wherein removal of the guard key in the unsecured orientation of the guard lock will not prevent movement of the latch bolt to the unlocked position from the fully extended locked position.

3. A safety deposit box lock assembly comprising:

a housing;

a latch bolt carried by the housing and moveable between a locked and an unlocked position;

a guard lock movable by a guard key between an unsecured orientation permitting movement of the latch bolt to the unlocked position and a secured orientation prohibiting movement of the latch bolt to the unlocked position from the locked position;

a patron lock moveable by a patron key between a latched orientation that moves the latch bolt to the locked position and an unlatched orientation only when the guard lock is in the unsecured orientation and that moves the latch bolt to the unlocked position; and wherein the guard key can be inserted into and removed from the guard lock both when the guard lock is in the secured orientation and in the unsecured, further comprising:

at least one guard lock tumbler lever; and a cam surface on an edge of each guard lock tumbler lever wherein each cam surface bears against a portion of the guard key when rotated to move each guard lock tumbler lever.

4. A safety deposit box lock assembly comprising:

a housing;

a latch bolt carried by the housing and moveable between a locked and an unlocked position;

a guard lock movable by a guard key between an unsecured orientation permitting movement of the latch bolt to the unlocked position and a secured orientation prohibiting movement of the latch bolt to the unlocked position from the locked position;

a patron lock moveable by a patron key between a latched orientation that moves the latch bolt to the locked position and an unlatched orientation only when the guard lock is in the unsecured orientation and that moves the latch bolt to the unlocked position; and wherein the guard key can be inserted into and removed from the guard lock both when the guard lock is in the secured orientation and in the unsecured, further comprising:

a plurality of guard lock tumbler levers; and a cam surface on an edge of each guard lock tumbler lever wherein each cam surface has at least one notch and wherein the notches align with one another when the guard lock is in the secured orientation to permit insertion and removal of the guard key in the secured orientation.

5. The safety deposit box lock assembly according to claim 4, further comprising:

a terminus at one edge of each cam surface wherein each terminus aligns with one another when the guard lock is in the unsecured orientation to permit insertion and removal of the guard key in the unsecured orientation.

6. The safety deposit box lock assembly according to claim 4, further comprising:

a bolt plate carrying the latch bolt;

a guard key post passing through a slot in the bolt plate and arranged generally perpendicular to the bolt plate; and a key groove formed along a longitudinal axis of the guard key post for grinding a portion of the guard key along the guard key post when the guard key is inserted in the guard lock, wherein the key groove aligns with each notch in each tumbler lever cam surface when the guard lock is in the secured position.

7. The safety deposit box lock assembly according to claim 5, further comprising:

a bolt plate carrying the latch bolt;

a guard key post passing through a slot in the bolt plate and arranged generally perpendicular to the bolt plate; and a key groove formed along a longitudinal axis of the guard key post for guiding a portion of the guard key along the guard key post when the guard key is inserted in the guard lock, wherein the key groove is positioned beyond the terminus of each tumbler lever cam surface when the guard lock is in the unsecured orientation.

8. The safety deposit box assembly according to claim 4, further comprising:

a plurality of dummy tumbler levers interspersed with the guard lock tumbler levers and that do not intersect with any of the notches, whereby the dummy tumbler levers do not interfere with insertion and removal of the guard key when the guard lock is in the secured orientation.

9. The safety deposit box lock assembly according to claim 5, further comprising:

a plurality of dummy tumbler levers that do not extend beyond the terminus of each guard lock tumbler lever cam surface, whereby the dummy tumbler levers do not interfere with insertion and removal of the guard key when the guard lock is in the unsecured orientation.

10. A safety deposit box lock assembly comprising:

a housing;

a bolt plate received in and movable relative to the housing between a locked and an unlocked position;

a latch bolt carried by the bolt plate that extends from a side of the housing to the fully extended position when the bolt plate is in the locked position and at least partly retracts into the housing when the bolt plate is in the unlocked position;

a guard lock that is actuated by rotating the guard key when inserted in the guard key opening, where in the guard lock permits movement of the bolt plate to the unlocked position from the locked position when in an unsecured orientation and that prohibits movement of the bolt plate to the unlocked position from the fully extended locked position when in a secured orientation;

a patron key opening in the face of the housing adapted to receive a patron key therein;

a patron lock that is actuated by rotating the patron key when inserted in the patron key opening, wherein the patron lock permits movement of the bolt plate to the unlocked position only when the guard lock assembly is in the unsecured orientation and when the patron lock assembly is in an unlatched orientation and wherein the patron lock permits movement of the bolt plate to the locked position when the guard lock is in the secured orientation; and wherein the guard key can be inserted into and removed from the guard key opening both when the guard lock assembly is in the secured orientation and when in the unsecured orientation with the bolt in the fully extended position while permitting movement of the bolt from the fully extended position subsequent to the removal of the guard key.

11. The safety deposit box lock assembly according to claim 10, wherein the guard lock further comprises:

a pin extending from a portion of the bolt plate;

a plurality of guard lock tumbler levers; and a cam surface on an edge of each of the guard lock tumbler levers, wherein each cam surface bares against a portion of the guard key when rotated to move each guard lock tumbler lever.

12. The safety deposit box lock assembly according to claim 11, wherein the guard lock further comprises:

at least one notch formed at one end of each cam surface, wherein the notches align with one another when the guard lock is in the secured orientation to permit insertion and removal of the guard key in the secured orientation.

13. The safety deposit box lock assembly according to claim 12, wherein the guard lock further comprises:

a terminus at one edge of each cam surface opposite the notches, wherein each terminus aligns with one another when the guard lock is in the unsecured orientation to permit insertion and removal of the guard key in the unsecured orientation.

14. The safety deposit box lock assembly according to claim 11, wherein the guard lock further comprises:

a pin slot formed in each guard lock tumbler lever wherein each pin slot is aligned with the pin when the guard lock is in the unsecured orientation so that the pin can be received within the pin slots in the unsecured orientation.

15. The safety deposit box lock assembly according to claim 13, wherein the guard lock further comprises:

a guard key post passing through a slot in the bolt plate and arranged generally perpendicular to the bolt plate; and a key groove formed along a longitudinal axis of the guard key post for guiding a portion of the guard key along the guard key post when the guard key is inserted in the guard lock, wherein the key groove aligns with each notch in each tumbler lever cam surface when the guard lock is in the secured orientation, and wherein the key groove is positioned beyond the terminus of each tumbler lever cam surface when the guard lock is in the unsecured orientation.

16. The safety deposit box lock assembly according to claim 15, wherein he guard lock further comprises:

a plurality of dummy tumbler levers interspersed with the guard lock tumbler levers, wherein the dummy tumbler levers do not intersect with any of the notches and do not extend beyond the terminus of each guard lock tumbler lever cam surface.

17. The safety deposit box lock assembly according claim 11, wherein the guard lock further comprises:

a pivot pin extending from a portion of the housing; and a pivot pin slot formed in each of the guard lock tumbler levers permitting each of the guard lock tumbler levers to pivot about the pivot pin and to move laterally relative to the pivot pin.

18. The safety deposit box lock assembly according to claim 17, wherein the guard lock further comprises:

a bearing surface formed on one end of the cam surface of each guard lock tumbler lever near the terminus, wherein the guard key strikes the bearing surface when being moved from the secured orientation to the unsecured orientation in order to move each of the guard lock tumbler levers laterally relative to the pivot pin.

19. The safety deposit box lock assembly according to claim 11, wherein the guard lock further comprises:

a spring arm extending from each of the guard lock tumbler levers to bias the tumbler levers away from the housing and toward the secured orientation.

* * * * *